US006752457B2

(12) United States Patent
Gold et al.

(10) Patent No.: US 6,752,457 B2
(45) Date of Patent: Jun. 22, 2004

(54) INFANT SUPPORT CUSHION WITH ADJUSTABLE SIDE FLAPS

(75) Inventors: Katherine Gold, Denver, CO (US); Wendy A. Garrett, Denver, CO (US)

(73) Assignee: Gold Bug, Inc., Denver, CO (US)

( * ) Notice: Subject to any disclaimer, the term of this patent is extended or adjusted under 35 U.S.C. 154(b) by 0 days.

(21) Appl. No.: 10/208,627

(22) Filed: Jul. 29, 2002

(65) Prior Publication Data

US 2004/0017100 A1 Jan. 29, 2004

(51) Int. Cl.[7] ..... A47C 31/00
(52) U.S. Cl. ..... 297/219.12; 297/485
(58) Field of Search ..... 297/219.12, 223, 297/229, 220, 284.9, 397, 485

(56) References Cited

U.S. PATENT DOCUMENTS

| | | | | | |
|---|---|---|---|---|---|
| 3,199,916 | A | * | 8/1965 | Chiarenza | 297/223 |
| 4,434,513 | A | | 3/1984 | Welch | |
| 4,568,125 | A | * | 2/1986 | Sckolnik | 297/467 |
| 4,779,930 | A | * | 10/1988 | Rosen | 297/464 |
| 4,892,357 | A | * | 1/1990 | Nieto-Busby et al. | 297/464 |
| 5,123,699 | A | * | 6/1992 | Warburton | 297/219.1 |
| D328,683 | S | | 8/1992 | Kalozdi | |
| 5,441,328 | A | | 8/1995 | Snyder | |
| 5,482,352 | A | * | 1/1996 | Leal et al. | 297/217.4 |
| 5,586,351 | A | | 12/1996 | Ive | |
| 5,678,888 | A | * | 10/1997 | Sowell et al. | 297/256.17 |
| 5,681,083 | A | * | 10/1997 | Nelson et al. | 297/284.1 |
| 5,735,576 | A | | 4/1998 | Pepys | |
| 5,842,739 | A | * | 12/1998 | Noble | 297/219.12 |
| 5,918,933 | A | * | 7/1999 | Hutchinson et al. | 297/219.12 |
| 5,954,404 | A | * | 9/1999 | Suzuki | 297/467 |
| 5,979,981 | A | * | 11/1999 | Dunne et al. | 297/219.12 |
| 6,036,263 | A | * | 3/2000 | Gold | 297/219.12 |

FOREIGN PATENT DOCUMENTS

WO WO 9319651 A1 * 10/1993 ..... A47C/31/00

* cited by examiner

*Primary Examiner*—Peter M. Cuomo
*Assistant Examiner*—Stephen D'Adamo
(74) *Attorney, Agent, or Firm*—Ellen Reilly; John E. Reilly

(57) ABSTRACT

A support cushion for newborns, infants and toddlers that is adjustable with the growth of the child. The cushion is formed of an upper panel, a lower panel and adjustable side flaps that aid in supporting the head, neck and body of an infant. The upper panel contains a padded section with a corresponding depression to support an infant's head. The side flaps are removable so that the upper and lower panels provide a cushioned head and body support for a toddler that can be placed in a carseat, baby jogger or stroller.

14 Claims, 3 Drawing Sheets

INFANT SUPPORT CUSHION WITH ADJUSTABLE SIDE FLAPS

BACKGROUND AND FIELD OF INVENTION

This invention relates to baby support cushions; and more particularly relates to a novel and improved support cushion with adjustable side flaps for infants and toddlers.

The need for infant support cushions that are adjustable and can be placed in swings, strollers, carseats, joggers and the like is very apparent. Very small infants are typically placed in carseats, swings and baby joggers but their body mass is such that there is typically not enough support in these items to keep a small infant in the sitting position. As a result, the infant will commonly slide down into a slouching position or the infant's head can roll forward, almost touching the infant's knees or toes, posing a risk of suffocation. This problem is further complicated when the infant begins to grow, requiring purchase of a larger support column so that the infant is supported in the body but requiring somewhat less support of the head and neck. Finally, most toddlers do not require the degree of head and neck support that a young infant does but will have preferences concerning the comfort of any support cushion. This necessitates the purchase of three separate support cushions for the same infant. This invention satisfies the unmet need of an adjustable support cushion for a very small infant or newborn, growing infant and a toddler. It is therefore desirable to provide an adjustable support cushion for newborns, infants and toddlers which will not only support the head and body of a very small infant but offer comfort and support to a toddler.

SUMMARY OF THE INVENTION

It is therefore an object of the present invention to provide for a novel and improved support cushion with adjustable side flaps for infants and toddlers.

It is particularly an object of the present invention to provide an adjustable support cushion for the head, neck and body of a newborn or small infant.

It is another object of the present invention to provide a flat cushioned surface for an infant to be placed on for the purpose of changing a diaper or resting.

It is another object of the present invention to provide an infant support cushion which can be adjusted according to the size of the infant using removable side flaps.

It is another object of the present invention to provide an adjustable support cushion which can be used in a number of different ways, such as, in strollers, carseats, baby joggers, swings, infant carriers and the like.

It is another object of the present invention to provide a comfortable support cushion for toddlers that supports the head and body either in an upright or prone position.

In accordance with the present invention, a support cushion for newborns, infants and toddlers having a unitary panel including an upper and lower panel portion with adjustable side flaps releasably fastened on opposite sides of the upper and lower panel portions. The cushion includes opposite outer surfaces and a padded layer, the opposite outer surfaces being joined together at their edges as a rolled seam. The side flaps are releasably fastened to the side edges of the upper and lower panel portions in overlapping relation with one another to define a seat with side support and to orient the side flaps, upper and lower panel portions at substantially right angles to one another in an upright position. The cushion is covered with a protective water-proof material. The upper border of the upper panel contains additional padding of inverted U-shaped configuration with opposite sides converging downwardly just inside of the opposite side edges of the downwardly convergent panels. A lower panel is secured to the upper panel with stitching, and the lower panel includes seat cushioning for an infant or toddler.

The side flaps are generally trapezoidal in shape each having a forwardly and downwardly divergent front edge to provide side support for the head, neck and body of a newborn or infant. When the side flaps are secured to the opposite edges of the upper and lower panel portions, a cushioned seat is formed, providing further support to newborns or small infants. The flaps can be removed altogether, leaving head, back, seat, and leg cushioning for a toddler.

The side flaps are generally trapezoidal in shape to provide side support for the head, neck and body of a newborn or infant. When the side flaps are secured to the opposite edges of the upper and lower panels, a cushioned seat is formed, providing further support to newborns or small infants. The flaps can be removed altogether, leaving head, back, seat, and leg cushioning for a toddler.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

Referring in more detail to the drawings, as shown in FIGS. 1 through 6, a preferred embodiment of the present invention is described. In this particular preferred embodiment, an infant support cushion with adjustable side flaps is illustrated. It is to be clearly understood that this preferred embodiment is provided for descriptive purposes only and is not meant to unduly limit the scope of the inventive concept. Other embodiments are included within the inventive concept as set forth in the appended claims.

Figure 1:
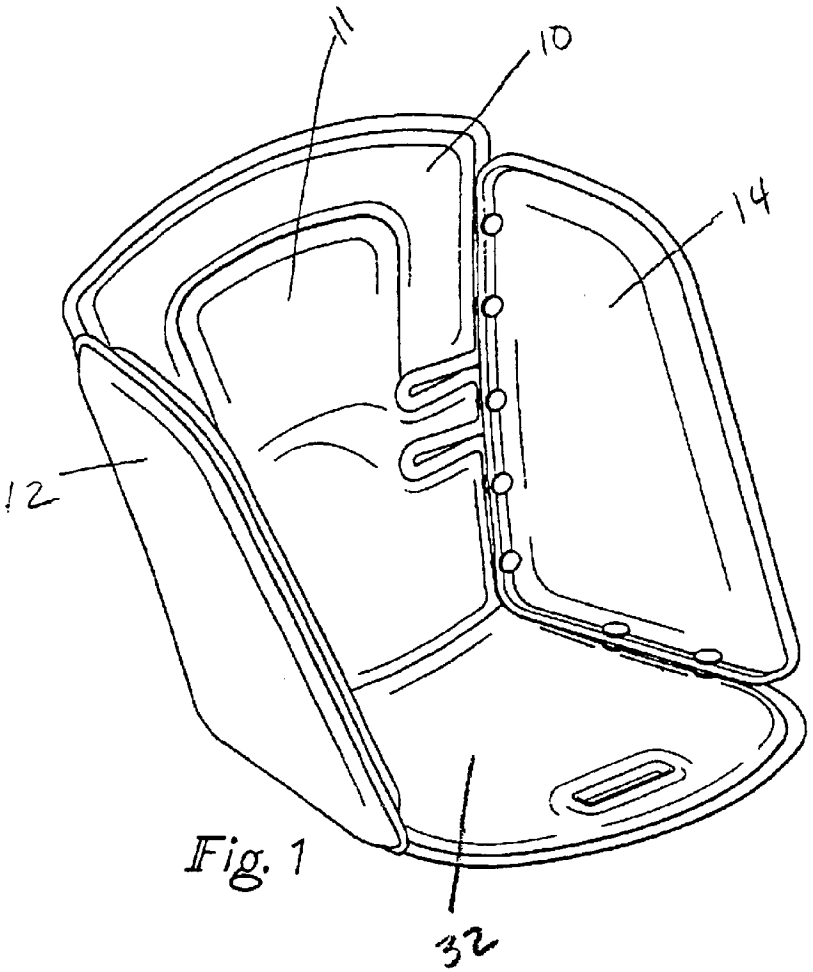
FIG. 1 is a perspective view of the present invention illustrating the adjustable support cushion with the side flaps connected to the upper and lower panels forming a seat.

The adjustable support cushion 10 as shown in FIG. 1 is intended for use in an infant or toddler carseat, jogger, stroller, bassinet or other location where an infant or toddler may be placed. The adjustable support cushion 10 includes a pair of padded generally trapezoidal side flaps 12, 14 that are removably secured to an upper panel portion 11 through the use of snap-type fasteners, a series of which are spaced along the adjoining edges of the upper panel 42, 44, 46, 48, 50, 52, 54, 56, 58 and 60 and side flaps 80, 82, 84, 86, 88, 90, 92, 94, 96 and 98 (FIG. 2) and a second series spaced along a lower edge of each side flap 62, 64, 66 and 68 (FIG. 2) and oriented so that they can be connected to the complementary snap portions 70, 72, 74 and 76 on opposite side edges of a lower panel 32 when the side panels are flexed forwardly from the support cushion and the lower panel is flexed upwardly into the position shown in FIG. 1. The upper and lower panels and side flaps are oriented at substantially right angles to one another in an upright position with overlapping side edges in mutually supporting relation to one another. These side flaps also provide added support and cushioning.

Figure 6:
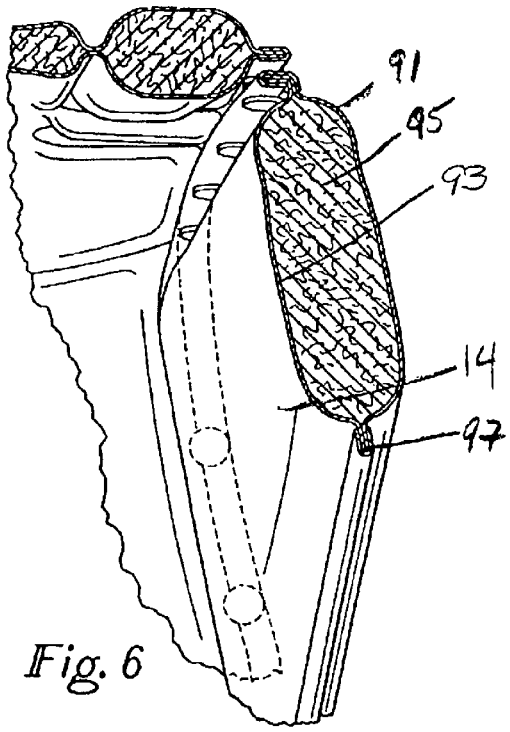
FIG. 6 is a sectional view of the side flap taken about lines 6—6 of FIG. 4.

The upper panel 11, lower panel 32, and side flaps 12 and 14 include opposite outer surfaces 91, 93, and a padded layer 95 as seen in FIG. 6, the opposite outer surfaces join together at their outer edges forming a rolled seam 97. The adjustable support cushion 10 is covered with a protective water-resistant material.

Figure 4:
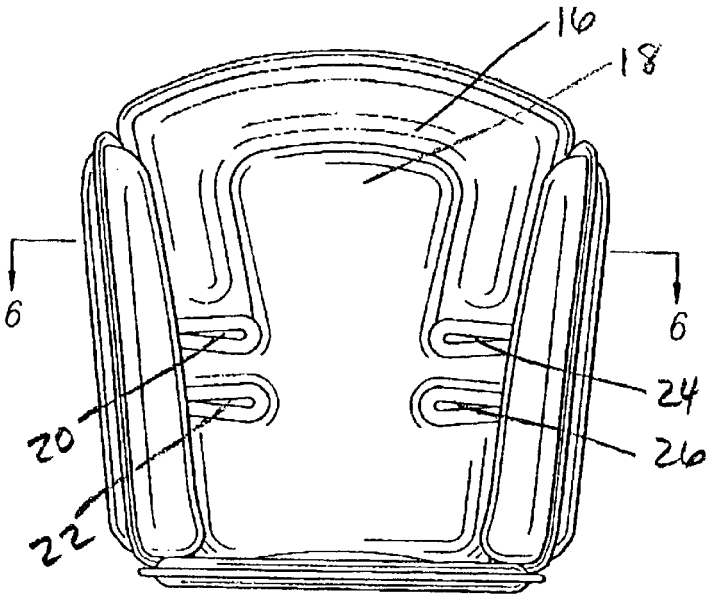
FIG. 4 is a front view of the invention of FIG. 1 including the side flaps and upper section.
Figure 5:
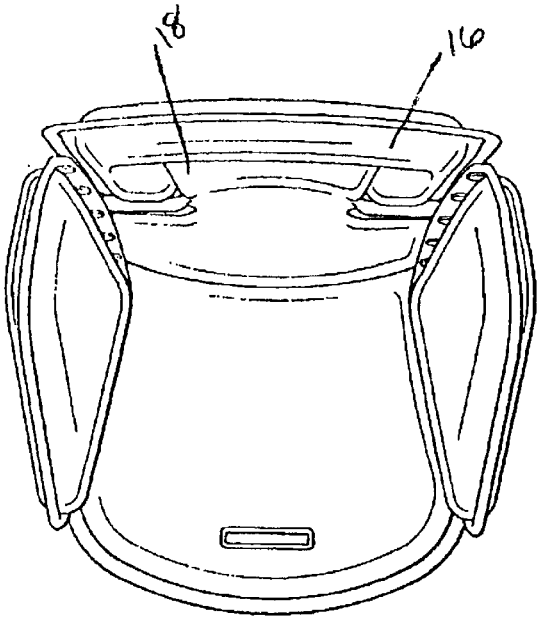
FIG. 5 is a sectional view of the top edge facing down.

The upper panel 11 comprises a head support pad 16, FIGS. 4 and 5, which is in the form of an inverted U-shape, and a corresponding depression 18 is formed where an infant or toddler's head may be placed. The upper panel 11 also comprises a pair of seat belt slots or openings 20, 22 and 24, 26, FIG. 4, located on opposite sides of the upper panel 11. A seat belt or other securing device may be passed through openings 20, 22 and 24, 26 to allow an infant or toddler to be secured, along with the support cushion within an infant carrier device or carseat.

Figure 2:
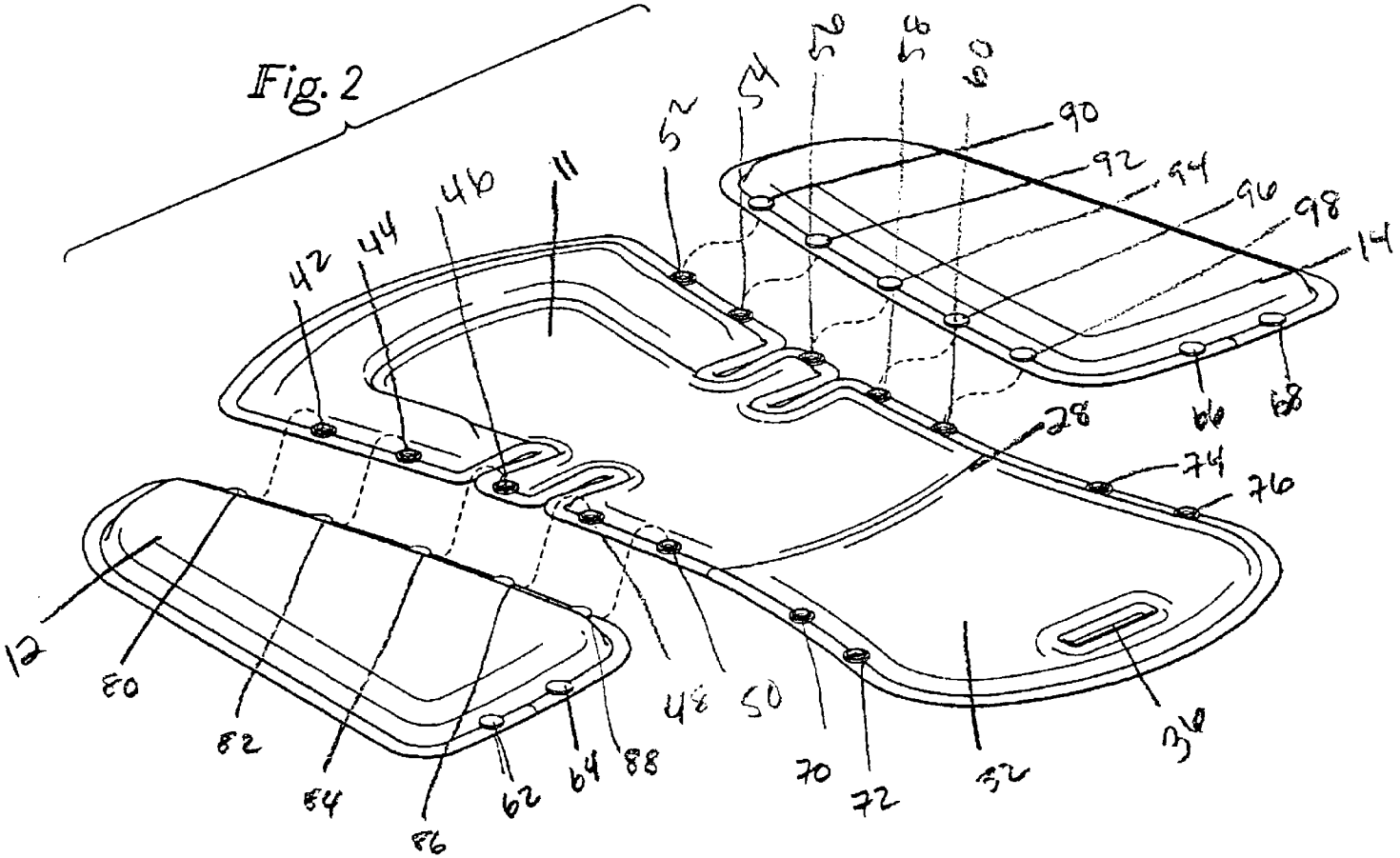
FIG. 2 is a perspective view of the invention of FIG. 1 in the extended position with the side flaps removed.

The upper panel 11 is permanently connected to the lower section 32 by a line of stitching 28 as shown in FIG. 2. This allows for flexing or folding of the lower panel upwardly with respect to the upper panel. In addition, there is a uniform amount of padding throughout the greater area of the upper and lower panels, including the side flaps 12, 14 as demonstrated in FIG. 6. The lower panel 32 contains an opening 36 designed to accommodate a securing strap that can be passed through the opening to secure an infant or toddler and the support cushion 10 to a support device such as an infant carseat, carrier or similar type of support vehicle.

The side flaps 12 and 14 have additional fasteners 62, 64, 66, 68 along lower portions of the flaps, FIG. 2. The fasteners may be connected to complementary fasteners 70, 72, 74, 76 that are located along each side of the lower panel 32. Connection of all of the fasteners, as demonstrated in FIG. 1, will result in the formation of a seat, providing additional support for a newborn or small infant. The side flaps 12 and 14, when fastened only to the upper panel 11, afford greater cushioning and support for an infant when the cushion is placed in the extended position as demonstrated in FIG. 2. Further, fastening only the upper panel 11 with the side flaps 12 and 14, and placing the cushion 10 in an infant carseat, jogger, or stroller, affords a growing infant support and cushioning around the head, neck and body, while also allowing the infant ample room for growth. See FIG. 3.

Fastening the side flaps 12 and 14 to only the lower panel 32 along the lower portions of the flaps, affords greater ventilation for the infant while leaving the lower portions attached to the lower panel so they are not lost or misplaced.

Figure 3:
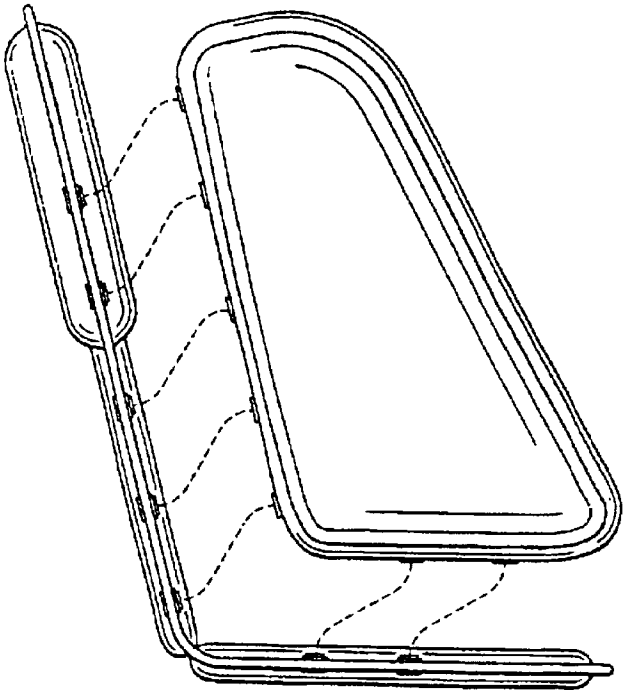
FIG. 3 is a side view of the invention of FIG. 1 with the side flaps removed.

The side flaps 12 and 14 may also be removed from the main body of the adjustable support cushion as demonstrated in FIG. 2 and FIG. 3, thereby leaving a support cushion for the head and body of a larger infant or toddler that can be placed in a carseat, baby jogger or the like. Removal of the side flaps 12 and 14 allows an older infant or toddler to utilize the support cushion as they are growing without the necessity of purchasing a separate support cushion for each stage of an infant's growth.

It is therefore to be understood that while preferred forms of invention are herein set forth and disclosed that the above and other modifications and changes may be made therein without departing from the spirit and scope of the present invention as defined by the appended claims.

We claim:

1. An adjustable support cushion for infants and toddlers comprising:

a unitary panel including an upper panel portion and a lower panel portion;

a pair of generally trapezoidal side flaps, said side flaps diverging downwardly and forwardly along opposite sides of said upper panel portion and said lower panel portion; and fastening means for releasably connecting adjoining edges of said side flaps to said upper panel portion and said lower panel portion in overlapping relation to one another whereby to orient said side flaps, said upper panel portion and said lower panel portion at substantially right angles and in mutually supporting relation to one another in an upright position.

2. The adjustable support cushion according to claim 1 wherein a lower edge of said upper panel is connected to an upper edge of said lower panel and said opposite sides of said upper panel portion converge downwardly into alignment with said opposite sides of said lower panel portion.

3. The adjustable support cushion according to claim 1 wherein said upper panel portion includes an upper padded layer of inverted U-shaped configuration for supporting an infant's head.

4. The adjustable support cushion according to claim 1 wherein said fastening means include one or more snaps placed along an entire length of said adjoining edges.

5. The adjustable support cushion according to claim 1 wherein said side flaps and said upper and lower panel portions include reinforced edges.

6. An adjustable support cushion for infants and toddlers comprising:

a unitary member including an upper panel including padding, and a lower panel including padding;

securing means for interconnecting said upper panel and said lower panel whereby to define a seat member and a back member;

a pair of generally trapezoidal side flaps, said side flaps diverge downwardly and forwardly along opposite sides of said upper panel; and fastening means for releasably connecting said side flaps along opposite side edges of said upper panel and said lower panel in overlapping, mutually supporting relation to one another whereby to retain said seat member and said back member at substantially right angles to one another.

7. An adjustable support cushion according to claim 6 wherein said fastening means includes snap fasteners interposed between said flaps and said upper and lower panels and is placed along at least two edges of said side flaps.

8. An adjustable support cushion according to claim 6 wherein said fastening means flexibly connect said pair of said side flaps to said unitary panel along an entire length of said adjoining side edges in overlapping relation for swinging or pivotal movement from a planar position to one at substantially right angles to said upper panel for releasable connection to said lower panel.

9. An adjustable support cushion according to claim 6 wherein said padding of said unitary panel and said side flaps is composed of a resilient material.

10. An adjustable support cushion according to claim 6 wherein said securing means includes stitching.

11. An adjustable support cushion for an infant or toddler comprising:

a padded, flexible back member including a lower edge;

a padded, flexible seat member, including an upper edge;

securing means for connecting said upper edge of said seat member to said lower edge of said back member whereby to define a conformable chair member;

a pair of padded, resilient generally trapezoidal-shaped side flaps each having a forwardly and downwardly divergent front edge; and fastening means for releasably connecting said side flaps in overlapping, mutually supporting relation with opposite sides of said chair member whereby to define a stable, configurable support cushion.

12. An adjustable support cushion according to claim 11 wherein said securing means include stitching.

13. An adjustable support cushion according to claim 11 wherein said fastening means include snap fasteners.

14. An adjustable support cushion according to claim 11 wherein said back member includes an upper padded layer of inverted U-shaped configuration for supporting an infant's head.

* * * * *